US005997347A

United States Patent [19]

Robinson et al.

[11] Patent Number: 5,997,347

[45] Date of Patent: Dec. 7, 1999

[54] WATTHOUR METER SOCKET ADAPTER WITH SNAP-ON JAW CONTACTS

[75] Inventors: Darrell Robinson, Highland Township; Karl R. Loehr, Novi; Allen V. Pruehs, Howell, all of Mich.

[73] Assignee: Ekstrom Industries, Inc., Farmington Hills, Mich.

[21] Appl. No.: 08/866,703

[22] Filed: May 30, 1997

Related U.S. Application Data

[60] Provisional application No. 60/018,878, Jun. 3, 1996.

[51] Int. Cl.[6] ..... H01R 33/945

[52] U.S. Cl. ..... 439/517; 439/745; 439/747; 439/856

[58] Field of Search ..... 439/517, 146, 439/167, 508, 733.1

[56] References Cited

U.S. PATENT DOCUMENTS

| | | | |
|---|---|---|---|
| Re. 34,531 | 2/1994 | Bell et al. . | |
| 2,468,368 | 4/1949 | Jackson | 439/747 |
| 3,031,640 | 4/1962 | McKee | 439/745 |
| 3,643,209 | 2/1972 | Coston . | |
| 3,880,494 | 4/1975 | Reed et al. | 439/517 |
| 4,127,924 | 12/1978 | Ross | 439/413 |
| 4,388,670 | 6/1983 | Billhartz . | |
| 4,892,485 | 1/1990 | Patton . | |
| 4,977,482 | 12/1990 | Langdon et al. . | |
| 5,023,747 | 6/1991 | Lindsay . | |
| 5,129,841 | 7/1992 | Alina et al. | 439/508 |
| 5,145,422 | 9/1992 | Fry | 439/856 |
| 5,207,595 | 5/1993 | Learmont et al. . | |
| 5,385,486 | 1/1995 | Robinson et al. . | |
| 5,423,695 | 6/1995 | Robinson et al. . | |
| 5,571,031 | 11/1996 | Robinson et al. . | |
| 5,577,933 | 11/1996 | Robinson et al. . | |
| 5,586,913 | 12/1996 | Robinson et al. . | |
| 5,590,179 | 12/1996 | Shincovich et al. . | |
| 5,596,234 | 1/1997 | Supienza | 439/214 |
| 5,704,804 | 1/1998 | Robinson et al. | 439/517 |

FOREIGN PATENT DOCUMENTS

| | | | |
|---|---|---|---|
| 0340951 | 4/1989 | European Pat. Off. | 439/745 |

*Primary Examiner*—Lincoln Donovan
*Assistant Examiner*—J. F. Duverne
*Attorney, Agent, or Firm*—Young & Basile, PC

[57] ABSTRACT

A jaw blade contact for a watthour meter socket adapter includes a terminal with a blade end and an opposed jaw contact end. A spring clip is fixedly mounted on the terminal and has a jaw contact end opposed from the jaw contact end of the terminal for receiving a blade terminal of a meter there-between. Angled arms carried on the spring clip releasibly engage the base of the socket adapter housing to mount the jaw blade contact on the housing in a snap-on connection. In another embodiment, a spring clip engages apertures in a jaw contact formed of two folded over portions to mount the jaw contact in the housing. The housing has a mounting flange with a frangible portion conformable to different sized socket cover openings. An arcuate surge ground conductor is mounted on the housing sidewall by an integral bendable member which is movable from an in-line position to a mounting position extendable through an aperture in the housing. One or more jaws of the jaw contact include at least first and second separately movable legs, each having a contact edge engageable with a blade terminal. The contact edges of the at least two legs are spaced apart along the length of the jaw to provide a stepped blade terminal insertion force.

39 Claims, 9 Drawing Sheets

WATTHOUR METER SOCKET ADAPTER WITH SNAP-ON JAW CONTACTS

CROSS REFERENCED TO CO-PENDING APPLICATION

This application claims the benefit of U.S. Provisional Application Serial No. 60/018,878, filed, Jun. 3, 1996.

BACKGROUND OF THE INVENTION

1. Field of the Invention

The present invention relates, in general, to watthour meters and meter sockets and, more specifically, to watthour meter socket adapters.

2. Description of the Art

In the electric utility industry, plug-in, socket-type watthour meters are commonly used to measure electric power consumption at residential or commercial sites. A socket housing is mounted on a convenient wall of the residence or commercial building and contains pairs of line and load terminals which are respectively connected to electric line and load conductors. The terminals receive blade contacts on a plug-in watthour meter to complete an electric circuit through the meter between the line and load terminals.

Plug-in socket adapters and socket adapters/extenders, both hereafter referred to simply as socket adapters, are designed to plug into the meter socket housing terminals. Such socket adapters are employed to convert ringless style sockets to ring style sockets or to extend the mounting position of the jaw terminals in the socket housing outward from the socket housing for mounting various electrical equipment, such as test devices or survey recorders, in the socket housing.

Such socket adapters employ a generally annular base having a shell joined thereto and extending outward from one side of the base. Contacts are mounted in the shell and base. Each contact has a female jaw portion disposed interiorly within the shell and a male blade terminal connected to the female jaw portion and extending outward from the shell and the base for a plug-in connection to the terminals in the meter socket housing.

Such socket adapters may be employed in both ring style and ringless style socket housings. In a ring style housing, a raised mounting flange is formed on the front cover of the socket housing to which the peripheral edge of the base of the socket adapter mates and is locked thereto by means of a conventional, annular, lockable sealing ring. In a ringless style socket housing, the peripheral edge flange of the base of the socket adapter is disposed interiorly within the socket housing in close proximity to or engagement with a raised annular portion of the cover surrounding an aperture through which the shell portion of the socket adapter extends. In both ringless and ring style socket housings, a separate sealing ring is mounted about an end mounting flange at the outer end of the shell to lockably mount a watthour meter to the socket adapter.

In previous watthour meter socket adapters, the jaw contacts were of two different constructions. In one construction, the jaw contacts have a folded over design formed of a base wall which is fixedly mounted to the shell of the socket adapter and two spaced side walls extending therefrom. The outer ends of the side walls are folded over inwardly between the side walls and terminate in parallel end flanges which slidably receive a blade terminal of a watthour meter.

In the second construction, the jaw contacts are formed of a generally planar terminal having opposed first and second ends. An angularly bent spring clip is riveted at one end to an intermediate portion of the terminal and extends to a contact edge disposed in separable engagement with the first end of the terminal to form a jaw for receiving the blade terminal of a watthour meter. The spring clip forcibly biases the watthour meter terminal into secure electrical engagement with the terminal. The second end of the blade terminal extends exteriorly from the base of the watthour meter socket adapter for releasable engagement in a socket jaw contact. A cotter pin is inserted through an intermediate aperture in the terminal to fixedly mount the terminal and jaw contact in position in the watthour meter socket adapter.

In both types of jaw contact constructions, the jaw contact presents a constant width surface to the insertion of a watthour meter blade terminal there passed. This requires a high insertion point to separate the contact edges of the jaw contact to enable the blade terminal to slide there-between.

In both bottom connected A to S type adapters as well as S-type socket extenders/adapters, a surge ground conductor is mounted on the meter mounting flange of the socket adapter to engage a ground tab on the base of the watthour meter when the watthour meter is coupled to the socket adapter. A separate wire conductor is connected to the surge ground conductor and passes through the base of the socket adapter to a ground connection in the meter socket. In other types of socket adapters, a rigid connector strap is connected to the surge ground conductor mounted on the meter mounting flange and extends to the base of the socket adapter where it is connected to the base of the socket adapter by a metal fastener. The fastener extends through the base of the socket adapter housing and serves as a mount for a metal tab. The metal tab is positioned exteriorly of the base of the socket adapter housing as in an S-type meter base and engages a corresponding ground contact or connection in the meter socket when the socket adapter is mounted in the meter socket.

In another arrangement of the surge ground conductor, disclosed in pending U.S. patent application Ser. No. 08/611,933, which is assigned to the Assignee of the present application, the surge ground conductor is formed with a first conductive portion of generally annular shape which is disposed in registry with the annular side wall of the socket adapter housing. At least one and, preferably, a pair of tabs extend angularly outward from one end of the first conductive portion and seat in notches formed in the mounting flange of the socket adapter housing. The top and/or bottom surfaces of the tabs are exposed to the mounting flange to enable contact between the tabs and a sealing ring and/or ground tab on a watthour meter when a watthour meter and a sealing ring are mounted on the socket adapter mounting flange. The first conductive portion is fixedly mounted on the sidewall of the shell by means of a mechanical fastener, such as a screw, which is also used to connect a second conductive member or strap to a ground connection externally of the socket adapter housing.

While the above described construction of a watthour meter socket adapter provides an effective socket adapter which fully meets all of its design and application requirements, the watthour meter socket adapter assembly process involves many steps which add to the overall cost of the socket adapter. For example, the base and shell are formed of two separate members which must be joined together by mechanical fasteners. Further, the jaw contacts in the socket adapter are mechanically mounted to the socket adapter housing by means of screws, cotter pins, etc.

Thus, it would be desirable to provide a watthour meter socket adapter which has a simplified construction for ease of manufacture with less separate manufacturing steps or operations. It would also be desirable to provide a watthour meter socket adapter which can be assembled with a minimal number of mechanical fasteners for a reduced cost and ease of manufacture. It would also be desirable to provide a watthour meter socket adapter having a mounting flange adaptable for mounting in ringless style watthour meter socket covers having varying diameter openings. It would also be desirable to provide a watthour meter socket adapter having a unique jaw contact construction which reduces the insertion force required to insert a blade terminal into the jaw contact; while still maintaining the high pull out force of the jaw contact.

SUMMARY OF THE INVENTION

The present invention is a watthour meter socket adapter having several unique features not previously found in conventional meter socket adapters.

The watthour meter socket adapter of the present invention includes a housing formed of a base, an annular side wall extending from the base, and a mounting flange formed on an outer edge of the annular side wall. In this embodiment, the base, side wall and mounting flange are integrally formed as a one-piece, unitary member. The annular side wall has a short height so as to provide a low overall profile or height to the socket adapter housing.

An optional breakaway edge portion is formed on an outer arcuate portion of the mounting flange. The breakaway edge portion may be removed to enable the socket adapter housing to be easily mounted in ringless-style watthour meter sockets having varying size cover openings.

A surge ground conductor is mounted on at least one and preferably two opposed sides of the side wall of the housing. The surge ground conductor is formed of an annular wall portion having two end tabs mountable in slots formed in the mounting flange of the socket adapter housing. A foot mounted on a lower end of the annular wall portion is bendable perpendicular to the annular wall after the foot has been inserted through a slot in the sidewall adjacent the base of the housing. The foot thus serves to mount the surge ground strap to the housing without the need for a separate mechanical fastener as in prior adapters. An optional leg may be formed contiguous with the foot so as to extend radially inward from the sidewall of the housing after the foot is bent into its mounting position to form a conveniently located contact for receiving a quick connector attached to a conductor.

A unique jaw contact is mountable in the socket adapter housing. In one embodiment, the jaw contact is formed of a single conductive member which is folded over onto itself to form two side by side, generally planar portions defining a blade terminal. The opposite ends of each folded over portion have an arcuate cross section with oppositely extending outer ends to define a jaw contact sized to releasibly receive a blade terminal of a meter, such as a watthour meter, in a plug-in connection.

A unique jaw contact mounting connector is also part of the present invention. The connector is formed of a single piece, spring metal member having a base with a hook portion engageable with a recess in the base of the socket adapter housing. At least one and preferably a pair of outer legs are formed on the connector. The at least one outer leg has a raised central portion which generates a biasing force on the jaw contact.

At least one and preferably a pair of spaced spring tabs extend from the base and are positioned to securely engage apertures formed in the blade terminal of the jaw contact as the jaw contact is slidably inserted through an aperture in the base of the socket adapter housing. The spring tabs securely mount the jaw contact in the housing. Further, the spring tabs co-act with the raised central portion of the connector to bias the jaw contact into a conductive position.

An optional post may also be formed on the base of the connector to receive a quick connector attached to an external conductor to enable the external conductor to be connected to the jaw contact.

Further, an optional second pair of legs may also be formed on the base of the connector extending laterally outward opposite from the outer end legs engageable with the jaw contact. The second pair of legs are also provided with a raised central portion to generate a biasing force to maintain the second pair of legs in secure electrical engagement with conductive portions of an external member or component mounted in the watthour meter socket adapter housing so as to electrically couple the external member to the jaw contact.

In another embodiment, the jaw contact comprises a jaw blade contact formed of a generally planar bus bar having opposed first and second ends. The first end is angled outward from the general plane of the bus bar.

A spring clip is riveted to the bus bar and has at least one and preferably a pair of angled legs extending toward the first end of the bus bar. A contact point or edge is formed on each leg and spaced from an outer tip end of each leg. The outer tip ends angle outward from the contact point of each leg to form a jaw opening in cooperation with the angled end of the bus bar for receiving a blade terminal of a watthour meter therein.

According to a unique feature, the contact points of the two legs of the spring clip are linearly offset along the length of the bus bar so as to reduce the push in force required to insert a watthour meter blade terminal between the joined bus bar and spring clip. Preferably, the contact point on one leg is spaced closer to the first end of the bus bar than the contact point of the second leg such that watthour meter blade terminal inserted between the bus bar and the legs of the spring clips contacts the first leg before contacting the second leg. This reduces the total insertion force; while still retaining the required high pull out force resistance. The width of the two legs may also be varied to control the step insertion force of a blade terminal into the jaw blade contact.

The above described jaw blade contact having longitudinally offset contact edges on at least two legs may also be employed in any type of electrical watthour meter socket adapter or any electrical device having jaw contacts positioned to receive terminals of a mating electrical device in a plug-in connection. In this type of application, the blade terminal and spring clip respectively form first and second jaw members of a single jaw contact. The steps the insertion force required to insert a terminal between the first and second jaws of a jaw contact thereby reducing the maximum insertion force required while still retaining a high pull-out force to retain the terminal in the jaw contact.

The offset contact edge arrangement of the at least two legs of each of at least one jaw of the present jaw contact may be applied to a conventional jaw blade terminal in a watthour meter socket adapter or a conventional watthour meter socket adapter jaw contact having inward folded contact ends. The axially offset or separated contact end arrangement of each jaw may be applied to one jaw or both jaws of a two jaw contact. In the latter embodiment, the aligned legs of each jaw are provided in the same shape to align the respective contact edges. However, the aligned contact edges of each pair of legs are, in turn, axially spaced from each other along the length of the jaw contact to provide the desired stepped insertion force when a blade terminal is urged into the jaw contact.

According to another embodiment, a pair of outward angled arms extend from the second ends of the spring clip. The arms are cantilevered from the second end of the spring clip and snap outward after the joined spring clip and bus bar have been inserted through a slot in the base of the socket adapter housing to forcibly engage a back surface of the base or a boss on the base to prevent removal of the jaw blade contact from the housing. Angled flanges are also formed intermediately on the spring clip and engage an upper surface on the base and/or the boss on the base of the socket adapter housing when the arms on the spring clip engage the back surface of the base and/or boss to fixedly mount the jaw blade contact in the housing without the need for separate fasteners.

The watthour meter socket adapter of the present invention utilizes fewer mechanical fasteners to assemble the various components thereby simplifying the manufacturing of the socket adapter as well as reducing its cost. The breakaway rim feature also enables a single watthour meter socket adapter to be mounted in ringless style watthour meter sockets having different sized cover openings.

Furthermore, the unique spring clip used on the jaw blade contact in one embodiment of the present invention significantly reduces the maximum watthour meter blade terminal insertion or push on force as the two legs of the spring clip have their contact points linearly offset along the length of the adjacent bus bar so as to stagger the insertion force exerted by each leg on the blade terminal.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
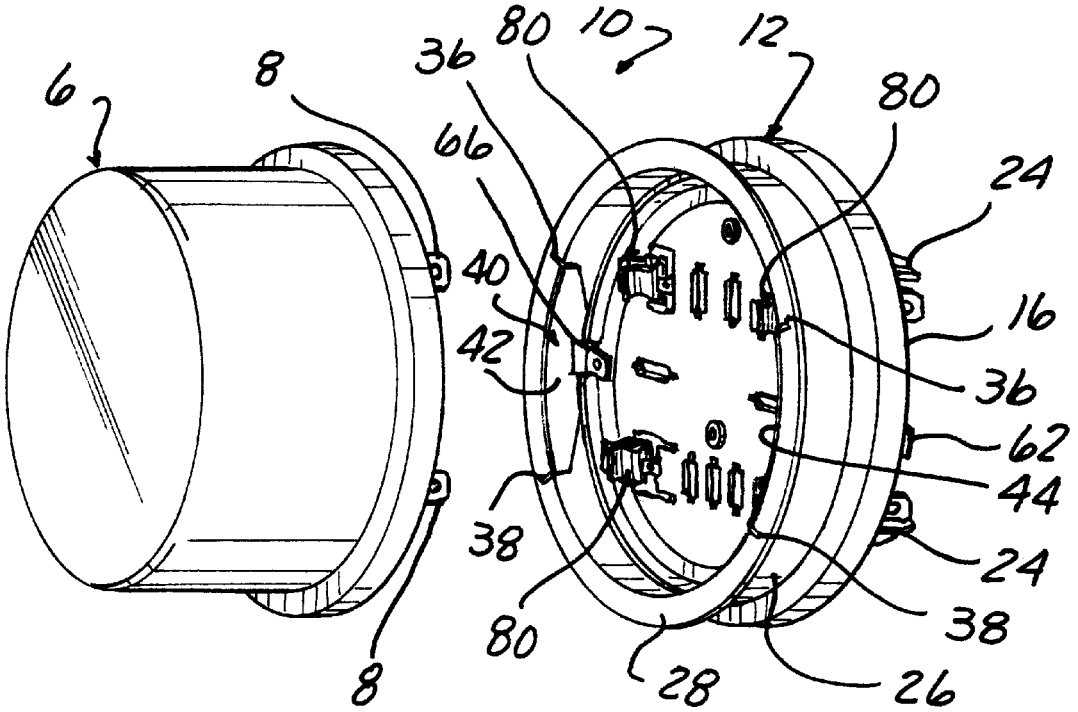
FIG. 1 is an exploded, perspective view of a meter socket adapter constructed in accordance of the teachings of the present invention.

A watthour meter socket adapter 10 having components constructed in accordance with the teachings of the present invention is depicted in FIGS. 1–10.

As shown in detail in FIGS. 1–4, the meter socket adapter 10, hereafter referred to simply as the "socket adapter 10" includes a housing 12. Preferably, the housing 12 is in the form of a one-piece, unitary, integrally formed component. Preferably, the housing 12 is integrally molded from a suitable electrically insulating material, such as polycarbonate.

The housing 12 includes a generally planar base 14 having a peripheral edge 16. A plurality of apertures, each denoted by reference number 18, are formed in the base 12 at the standard watthour meter blade terminal connection positions. A three phase arrangement of apertures 18 is depicted by way of example only in FIGS. 1–4.

Figure 4:
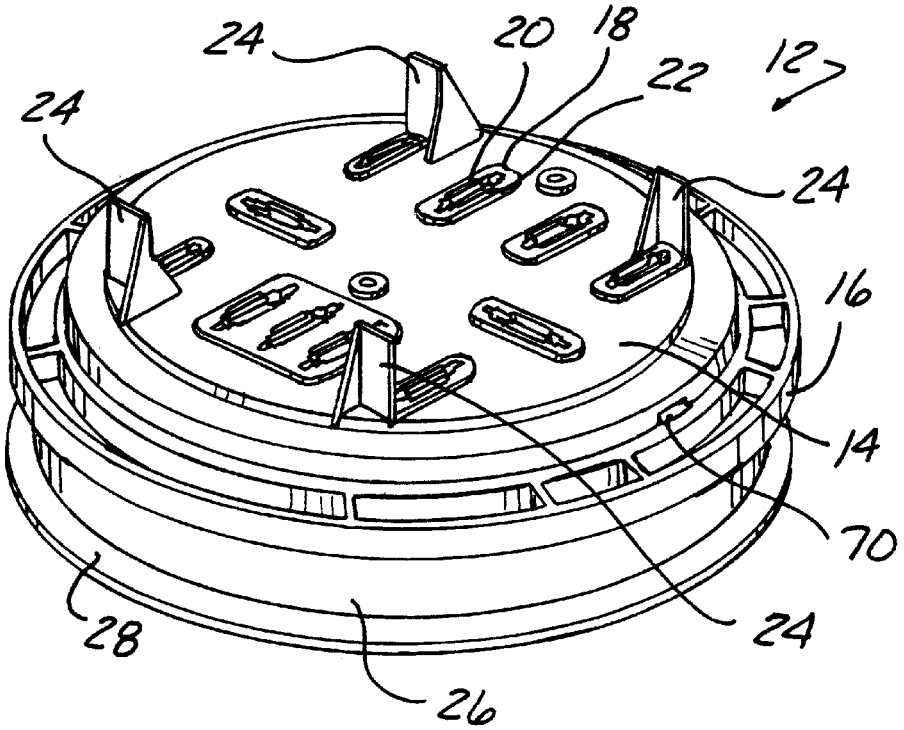
FIG. 4 is a rear perspective view of the meter socket adapter shown in FIG. 1.
Figure 2:
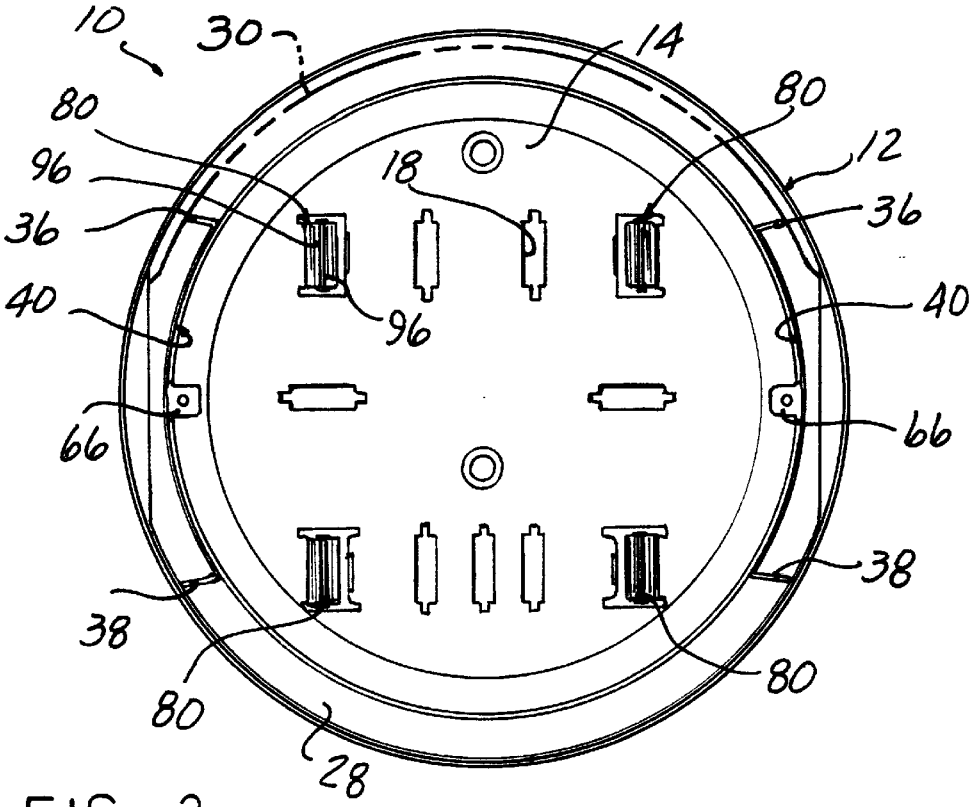
FIG. 2 is a front elevational view of the meter socket adapter shown in FIG. 1.
Figure 3:
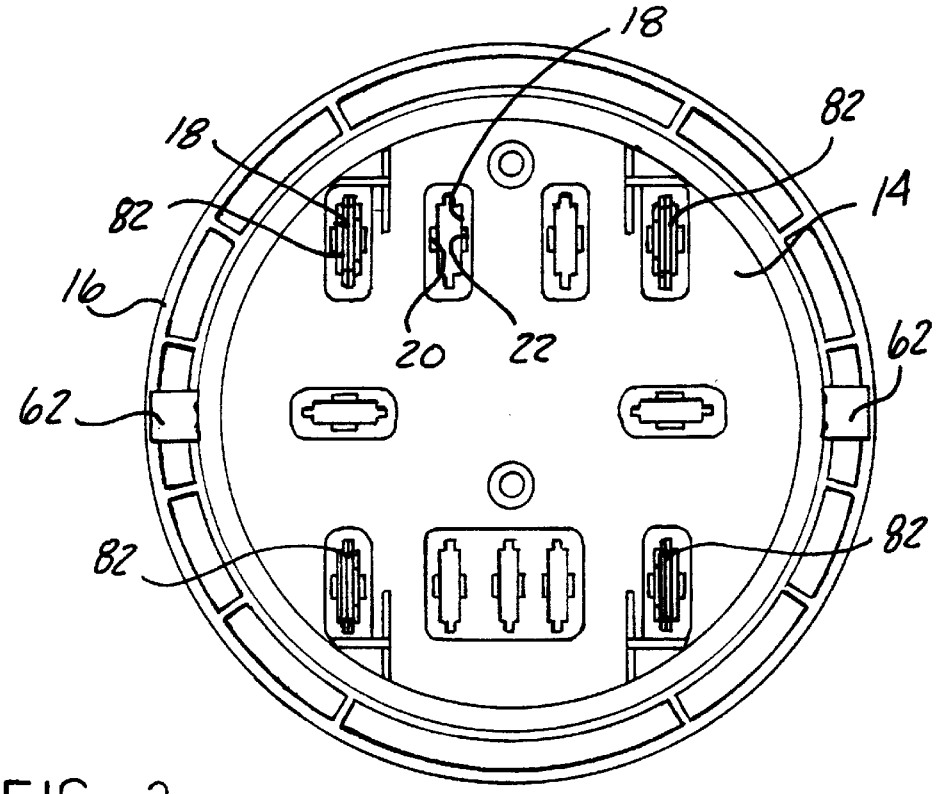
FIG. 3 is a rear elevational view of the meter socket adapter shown in FIG. 1.

Each aperture 18 has the shape shown in FIG. 2 on the front surface of the base 14 with a large outer portion and two smaller end portions. Each aperture 18 further extends through the base 14 between a front surface and a rear surface which is depicted in FIGS. 3 and 4. On the rear surface of the base 14, each aperture 18 includes a pair of opposed, shallow recesses 20 and 22 formed therein. The recesses 20 and 22 extend from the rear surface of the base 14 for a prescribed distance through the base 14; but not fully to the front surface of the base 14.

A plurality of spaced projections or meter feet 24 are formed in the base 14 and extend outward from the rear surface thereof. The meter feet 24 are provided at the four outermost aperture 18 positions in a conventional manner.

An annular side wall 26 integrally extends from the peripheral edge 16 of the base 14 for a short height or distance. The annular side wall 26 terminates in a mounting flange 28 having a radially extending peripheral edge. The mounting flange 28 mates with a corresponding mounting flange on a watthour meter and receives a sealing ring, not shown.

The height or length of the side wall 26 is substantially shorter than in previously devised socket adapters to provide a low profile to the socket adapter 10. The height difference between the side wall 26 and a prior art side wall is 1 15/32 inches. This causes the meter mounted in the socket adapter 10 to extend outward from the socket only 1/32 inches not the 2½ inches in prior adapters.

A unique feature of the present invention is shown in FIG. 2 wherein a breakaway portion 30 is formed in the mounting flange or rim 28. Reference number 30 depicts a score line, recess or narrowed thickness section on the mounting flange 26. As shown in FIG. 2, the breakaway section 30 extends in approximately a 180° arc over the periphery of the flange 28. The breakaway portion 30 can be removed by means of a suitable tool to enable the meter socket adapter 10 to be used with a ringless style watthour meter socket cover having a small diameter opening.

The meter socket adapter 10 of the present invention also has a unique ground surge means mounted therein. As shown in FIGS. 1 and 2, at least one pair of slots 36 and 38 are formed in the mounting flange 28. The slots 36 and 38 are spaced apart on the mounting flange 28 and extend from an inner edge of the mounting flange 28 at the juncture of the inner surface of the mounting flange 28 and the side wall 26 to a termination short of the peripheral edge of the mounting flange 28. In a preferred embodiment, two pairs of slots 36 and 38 are formed on the mounting flange 28, each pair of slots generally diametrically opposed from the other pair of slots as shown in FIGS. 1 and 2.

Figure 5:
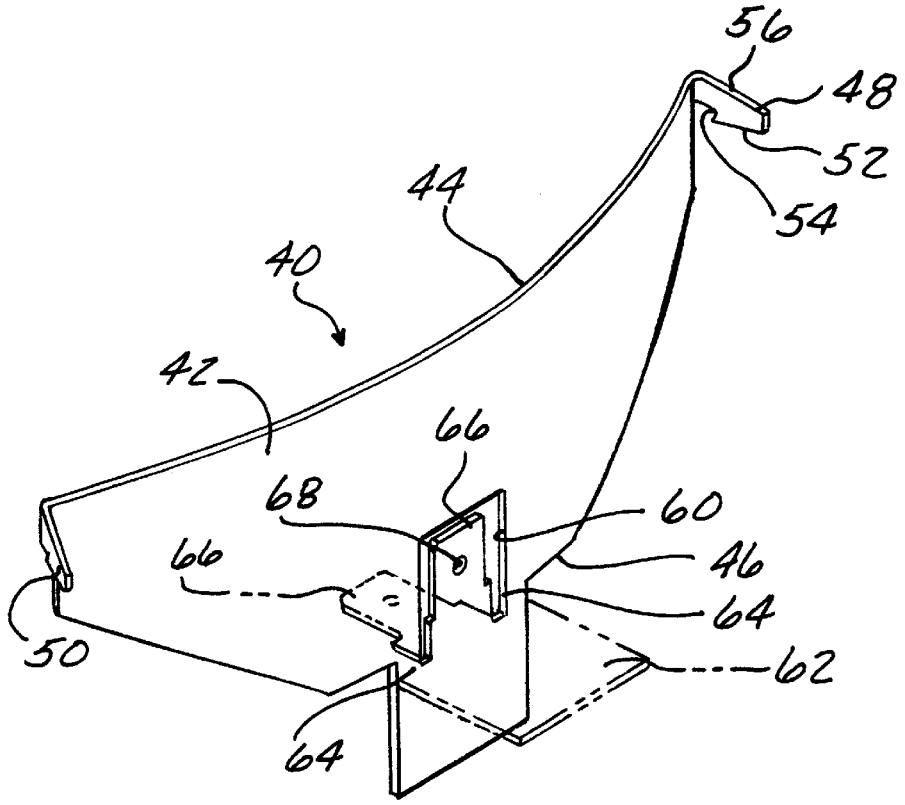
FIG. 5 is an enlarged, perspective view of a surge ground strap employed in the meter socket adapter shown in FIG. 1.

As shown in FIGS. 1 and 2, and in greater detail in FIG. 5, at least one and preferably two identical surge ground conductors 40 are diametrically mounted opposite each other on the mounting flange 28. Each surge ground conductor 40 is removably mounted in one pair of slots 36 and 38 and includes an arcuate wall portion 42 which conforms to the inner diameter of the annular side wall 26 of the housing 12. The arcuate wall portion 42 has an upper edge 44 and a lower edge 46. A pair of radially extending tabs 48 and 50 are formed on opposite side ends of the arcuate wall portion 42 generally adjacent the upper edge 44. Each tab 48 and 50 has a lower edge 52 which seats in a lower portion of the slots 36 and 38 on the mounting flange 28 of the socket adapter housing 12. A notch 54 is formed in each tab contiguous with the lower edge 52 as shown in FIG. 5. Each tab 48 and 50 has an upper edge 56 extending at an angle away from the planar lower edge 52 so as to dispose the top edge 44 of each surge ground conductor 40 slightly above the upper edge of the mounting flange 28. This places the upper edge of each surge ground conductor 40 at a position to electrically engage a ground terminal mounted on the rear surface of a conventional watthour meter.

Each surge ground conductor 40, shown in FIG. 5, has a cutout 60 formed in the lower edge 46. A movable mounting foot or tab 62 is pivotally connected by fingers 64 to the lower edge 46 of the arcuate wall portion 42. The mounting foot 62 has a generally planar shape as shown in FIG. 5. Opposite from the mounting foot 62 and contiguous therewith is a second planar portion or flange 66 having an optional aperture 68 formed therein.

As shown in solid in FIG. 5, in an initial, premounted state, the mounting foot 62 and contiguous flange 66 are generally in-line with the annular side wall 42 of each surge ground conductor 40. The mounting foot 62 is designed to be slidably inserted through an aperture 70 formed at the juncture of the base 14 and the annular side wall 26 of the socket adapter housing 12. Two slots 70 are diametrically formed in the housing 12 as shown in FIG. 3. One mounting foot 62 is inserted through one slot 70 after being bent generally perpendicular to the annular side wall 42 as shown in phantom in FIG. 5 until the foot 62 is disposed in proximity with the base 14 of the housing 12 to securely attach each surge ground conductor 40 to the housing 12.

At the same time, the pivotal or bending movement of the mounting foot 62 also causes a pivotal movement of the flange 66 to a radially inward extending position within the housing 12 as also shown in phantom in FIG. 5. In this position, the flange 66 is located to provide an easy connection with an electrical conductor to connect the electrical conductor to the surge ground conductor 40. Further, the flange 66 is preferably configured to receive a slide-on, quick connector attached to one end of an electrical conductor. By use of the integral mounting foot 62, each surge ground conductor 40 may be securely attached to the socket adapter housing 12 without the need for a separate fastener, rivet, etc., as required in previously devised surge ground conductors used in meter socket adapters.

The socket adapter 10 also includes a plurality of jaw contacts each denoted generally by reference number 80 in one embodiment of the invention. Preferably, the jaw contacts 80 are identically constructed as described hereafter. Four jaw contacts 80 are shown in FIGS. 1 and 2 for use in a single phase socket adapter 10. Additional jaw contacts 80 would obviously be employed for three phase applications.

Figure 6:
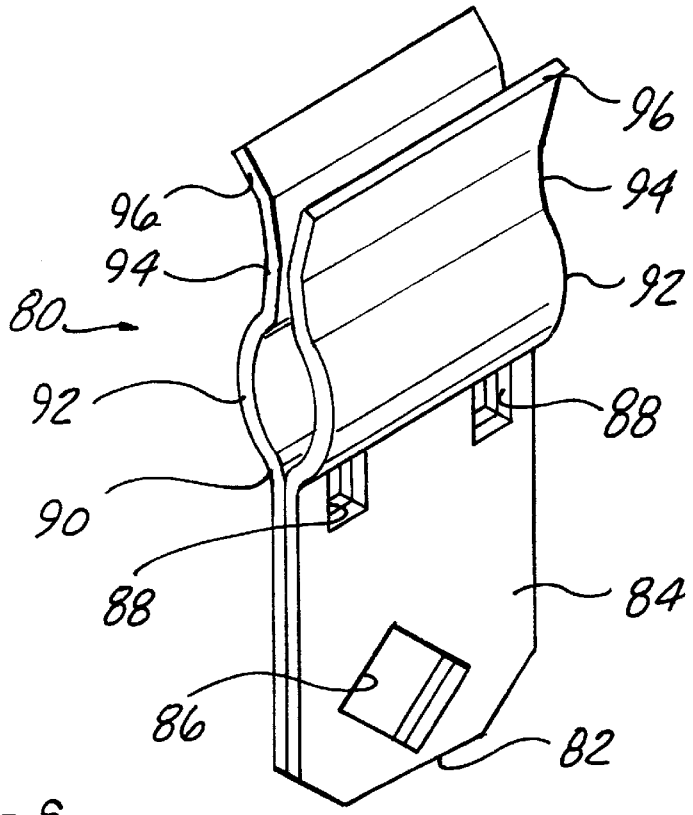
FIG. 6 is an enlarged, perspective view of a jaw contact constructed in accordance with the teachings of the present invention.

As shown in detail in FIG. 6, each jaw contact 80 is preferably formed of a single, one-piece electrically conductive member which is folded or bent at an end 82. The two side by side, planar portions form a lower blade terminal portion 84 on each jaw contact 80. A first generally rectangular aperture 86 is formed in a lower end of the blade terminal portion 84. At least one, and preferably a pair of smaller diameter, second apertures 88 are also formed in the blade terminal portion 84 and extend through each contiguous side portion thereof. The second apertures 88 are located at an opposite end of the blade terminal portion 84 from the end 82 as shown in FIG. 6.

The generally planar blade terminal portion 84 extends from the lower end 82 to an intermediate juncture point 90. From the juncture point 90, each side element of the jaw contact 80 curves radially outward to form an arcuate end portion 92 which curves radially inward toward the opposed element before being formed into a series of generally planar sections 94 which terminate in an angularly outwardly extending end portion 96. The flat portions 94 and outer end portions 96 form a jaw end which is sized to securely, yet releasibly receive a blade terminal 8 on a meter 6 shown in FIG. 1.

Figure 7:
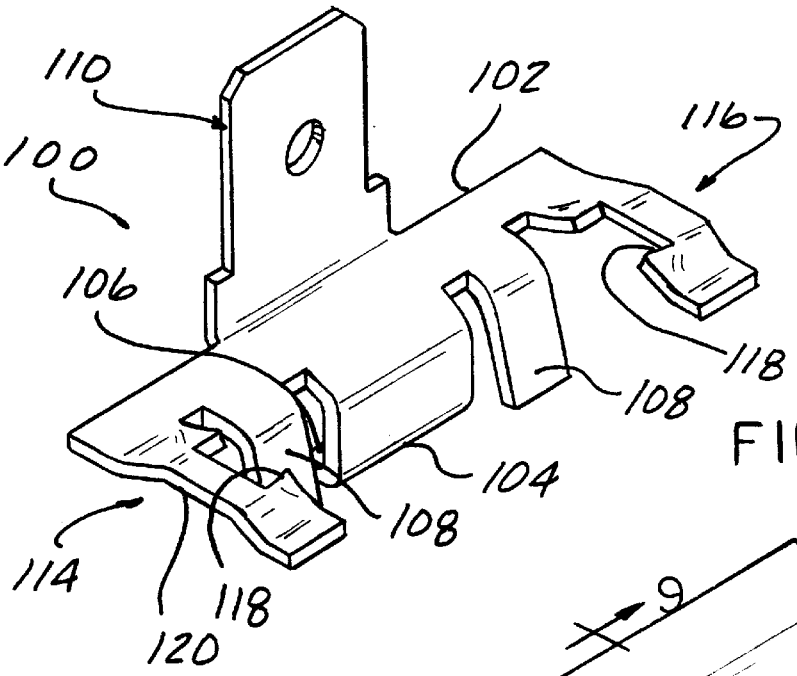
FIG. 7 is an enlarged, perspective view of a jaw contact connector according to the present invention.
Figure 8:
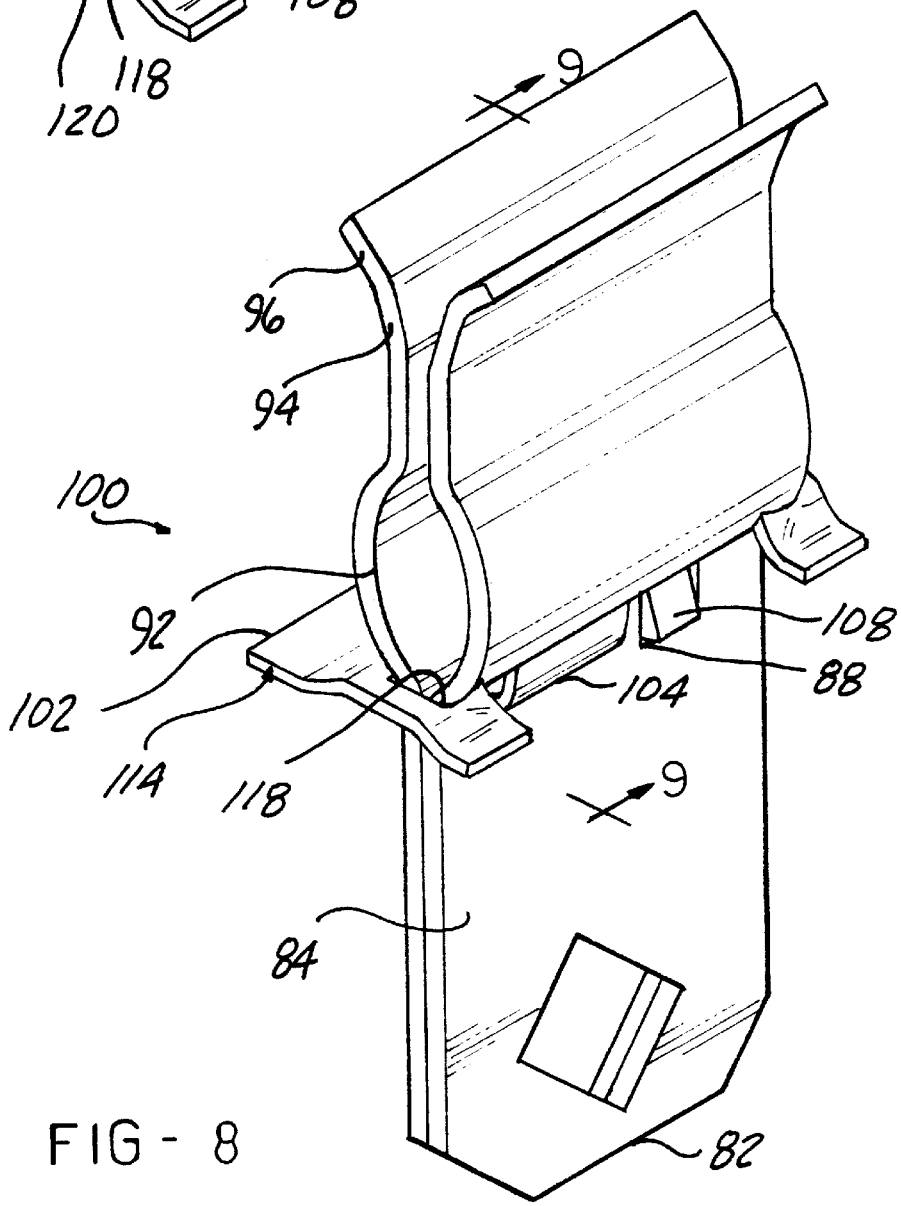
FIG. 8 is an enlarged, perspective view showing the interconnection of the jaw contact and connector shown in FIGS. 6 and 7.
Figure 9:
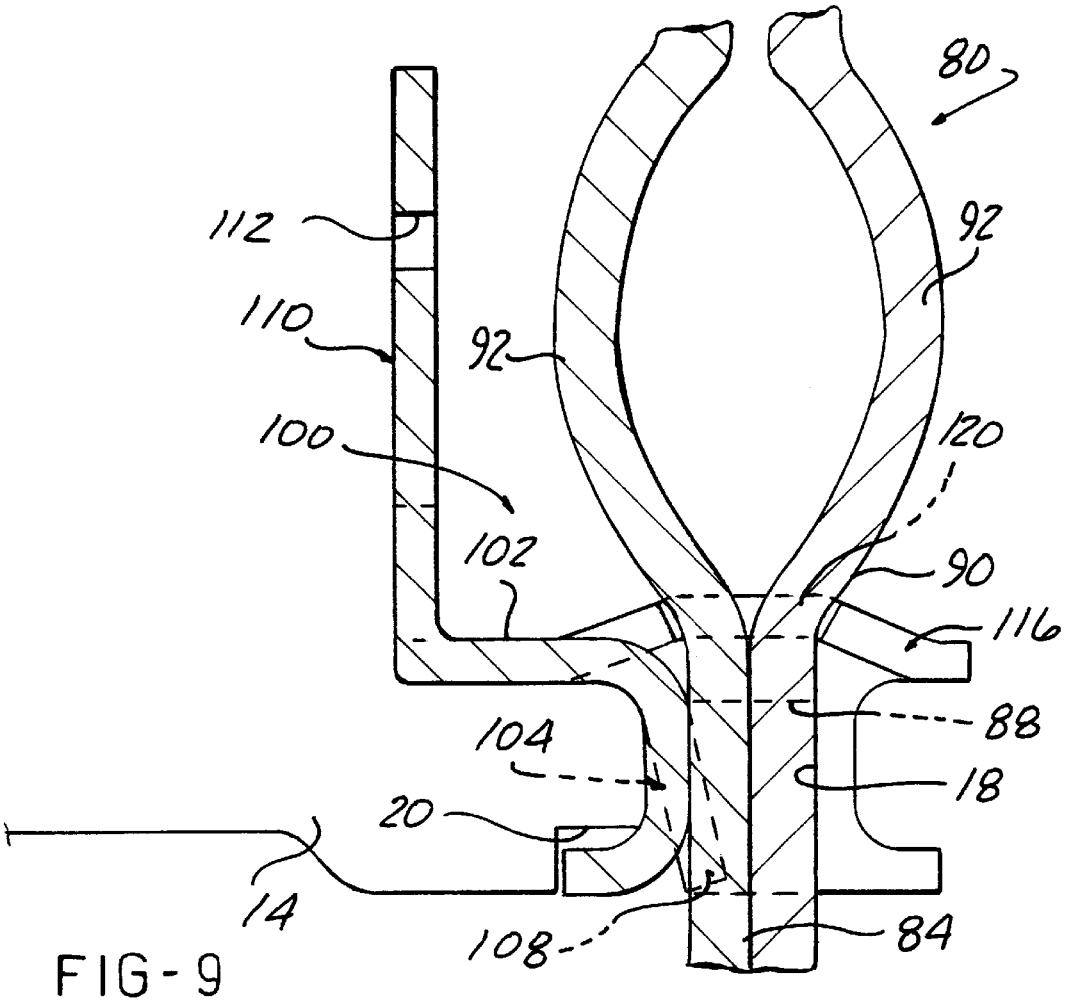
FIG. 9 is a cross sectional view generally taken along line 9—9 in FIG. 8.

According to the present invention, a unique jaw contact connector 100, shown in a first embodiment in FIGS. 7–9, is used to securely mount each jaw contact 80 in the housing 12. The connector 100 is formed of suitable material, such as a metal and, preferably, a spring metal, such as a spring steel or steel alloy. The connector 100 is formed with a base or end portion 102. A centrally located hook 104 extends from one edge of the base 102. The hook 104 has a generally U-shaped configuration as shown in FIG. 9. An end leg 106 of the hook 104 is designed to engage the recess 20 formed on the back surface of the base 14 after the hook 104 has been inserted through one of the apertures 18 and then moved laterally sideways in the aperture 18.

At least one and, preferably, a pair of spring tabs 108 extend angularly from the base 102 on opposite sides of the central hook 104. When the connector 100 is mounted in the housing 12, as described above, the spring tabs 108 extend angularly into the aperture 18 in the base 14 of the housing 12 and are disposed in a position to engage the blade terminal portion 84 of the jaw contact 80 when the jaw contact 80 is slidably inserted through the aperture 18. The spring tabs 108 snap into a aperture 88 on the jaw contact 80 to fixedly hold the jaw contact 80 in the aperture 18.

An optional, but preferred post 110 is also formed on the connector 100 and extends from one edge of the base 102 opposite from the hook 104. As shown in FIG. 7, the post 110 is generally centrally located on the base 12 and extends perpendicularly from the base 102. The post 110 has an aperture 112 formed therein. The post 110 is sized to slidably receive a quick connector, not shown, attached to an external conductor to enable the external conductor to be easily electrically connected to a jaw contact 80.

The connector 100 also includes a pair of outer end legs 114 and 116. Each outer end leg 114 and 116 extends laterally outward from one edge of the base 102. Each outer end leg 114 is generally spaced from one of the spring tabs 108 as shown in FIG. 7. Each outer end leg 114 and 116 has a central notch 118 formed therein. Each notch 118 is sized to receive one side edge of one jaw contact 80, as shown in FIG. 8, to position the jaw contact 80 in the connector 100.

Further, each outer end leg 114 and 116 has a raised central portion denoted by reference number 120 which is contains the notch 118. The raised central portion 120 is formed by an upper flat formed between two angular portions, one extending from the base 102 and the other forming a free end. This causes the raised central portion 120 to act as a biasing spring to urge the jaw contact 80 into a good electrically conductive position.

In assembling each jaw contact 80 and its associated connector 100, the hook 104 of each connector 100 is initially inserted through the aperture 18. The connector 100 is then moved laterally sideways with respect to the aperture 18 to bring the end 106 of the hook 104 into secure registry with the recess 20 formed in the back surface of the base 14. Next, the blade terminal portion 84 of a jaw contact 80 is inserted through the aligned notches 118 in the connector 100 and into the aperture 18 in the base 14 of the housing 12. An insertion force is necessary when the juncture point 90 of the jaw contact 80 initially contacts the raised central portions 120 of the outer end legs 114 and 116 to overcome the biasing force generated by the raised central portion 120. Such insertion force is applied to continue to slidably urge the jaw contact 80 through the aperture 18 until the spring tabs 108 engage and snap laterally into the second smaller apertures 88 in the blade terminal portion 84 of the jaw contact 80 to lock the jaw contact 80 in the connector 110 and in the housing 12.

Figure 10:
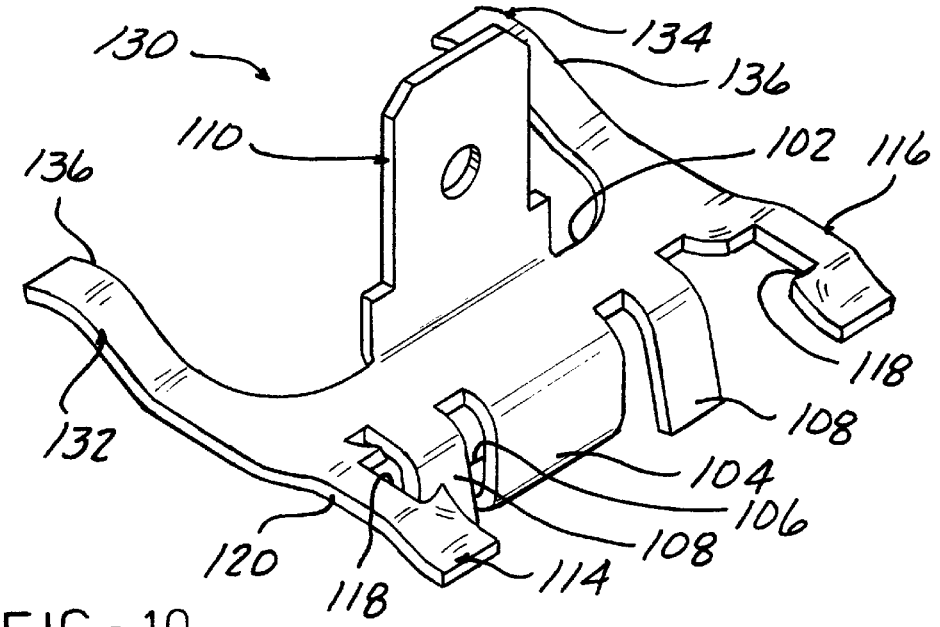
FIG. 10 is a perspective view of an alternate embodiment of the jaw contact connector according to the present inventions.

An alternate embodiment of the connector 130 is shown in FIG. 10. A connector 130 is substantially identical to the connector 110 described above in that it includes a base 102, a central hook 104, a pair of spaced spring tabs 108, and a pair of outer end legs 114 and 116. As in the connector 100, a mounting post 110 extends perpendicularly from the base 102 to provide a connection for a quick connector attached to one end of an external electrical conductor.

In this alternate embodiment, a second pair of laterally extending legs 132 and 134 are also formed on the connector 130, generally integral with the base 102. The second legs 132 and 134 are generally aligned with the outer end legs 114 and 116, but extend laterally outward from an opposite edge of the base 102. Further, the second end legs 132 and 134 have a raised central portion 136 which provides a biasing force in the same manner as the raised central portion 120 on the outer end legs 114 and 116. The raised central portions 136 of the second legs 132 and 134 are positioned to electrically engage external contacts on a member, not shown, mountable in the socket adapter housing 12, such as a circuit board having contact pads located at positions engageable with the raised central portions 136 of the second legs 132 and 134. The biasing force created by the raised central portions 136 ensures secure electrical contact between the external member and the connector 130 and thereby the jaw contact 80.

This unique jaw contact connector mounting arrangement provides a simple and expedient means for mounting a jaw contact in a housing of a meter socket adapter. The use of the separate connector eliminates the conventional cotter pin and associated labor required to mount the cotter pin through the blade terminal portion of each jaw contact while holding the jaw contact in position through the aperture in the base of the socket adapter housing. This connector arrangement also enables the blade terminal portion of each jaw contact to be made shorter thereby reducing the overall length/height of the meter socket adapter.

In another embodiment of the present invention shown in FIGS. 11–16, a jaw blade contact 150 is mountable in the socket adapter 10. The jaw blade contact 150 includes a bus bar denoted generally by reference number 152 and a spring clip denoted generally by reference number 154.

The bus bar 152 is formed of a suitable electrically conductive material, such as copper or copper plated aluminum. The bus bar 152 has a first or blade end 156 having a generally planar configuration. A plurality of apertures 158, 160 and 162 are axially spaced along the length of the first end of the bus bar 152. The intermediate aperture 160 is sized and positioned to receive a dimple or projection described hereafter on the spring clip 154. The aperture 162 is positioned to receive a rivet 184 for securely attaching the spring clip 154 and the bus bar 152.

Figure 11:
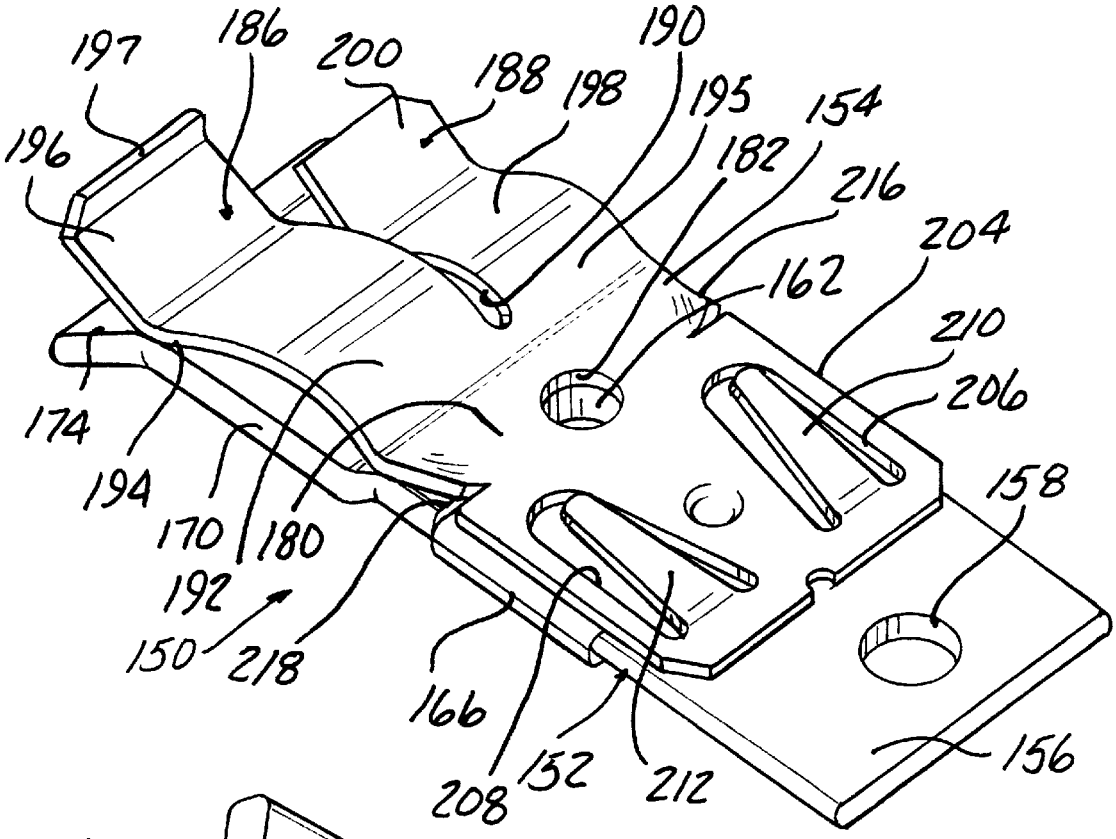
FIG. 11 is a perspective view of an assembled jaw blade contact constructed in accordance with one embodiment of the present invention.
Figure 12:
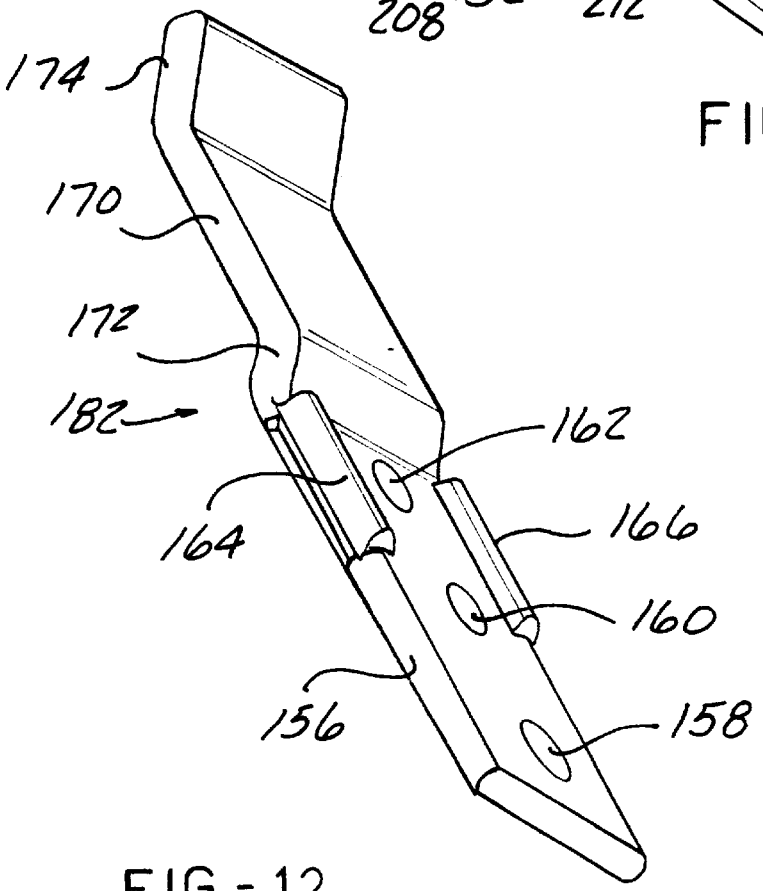
FIG. 12 is a rear perspective view of the bus bar used in the jaw blade contact shown in FIG. 11.

A pair of opposed flanges 164 and 166 project angularly, and preferably perpendicularly, from the first end portion 156 of the bus bar 152. As shown in FIGS. 11 and 12, the flanges 164 and 166 are generally intermediate the opposed ends of the bus bar 152. The flanges 164 and 166 fill the opening of one slot 18 in the base 14 of the socket adapter housing 12, as described hereafter.

The bus bar 152 has a second end 170 which is angularly offset by an angled portion 172 from the first end 156. An angled tip 174 extends angularly from the plane of the second end 170 to form a guide for insertion of a blade terminal adjacent to the bus bar 152 as also described hereafter.

Figure 13:
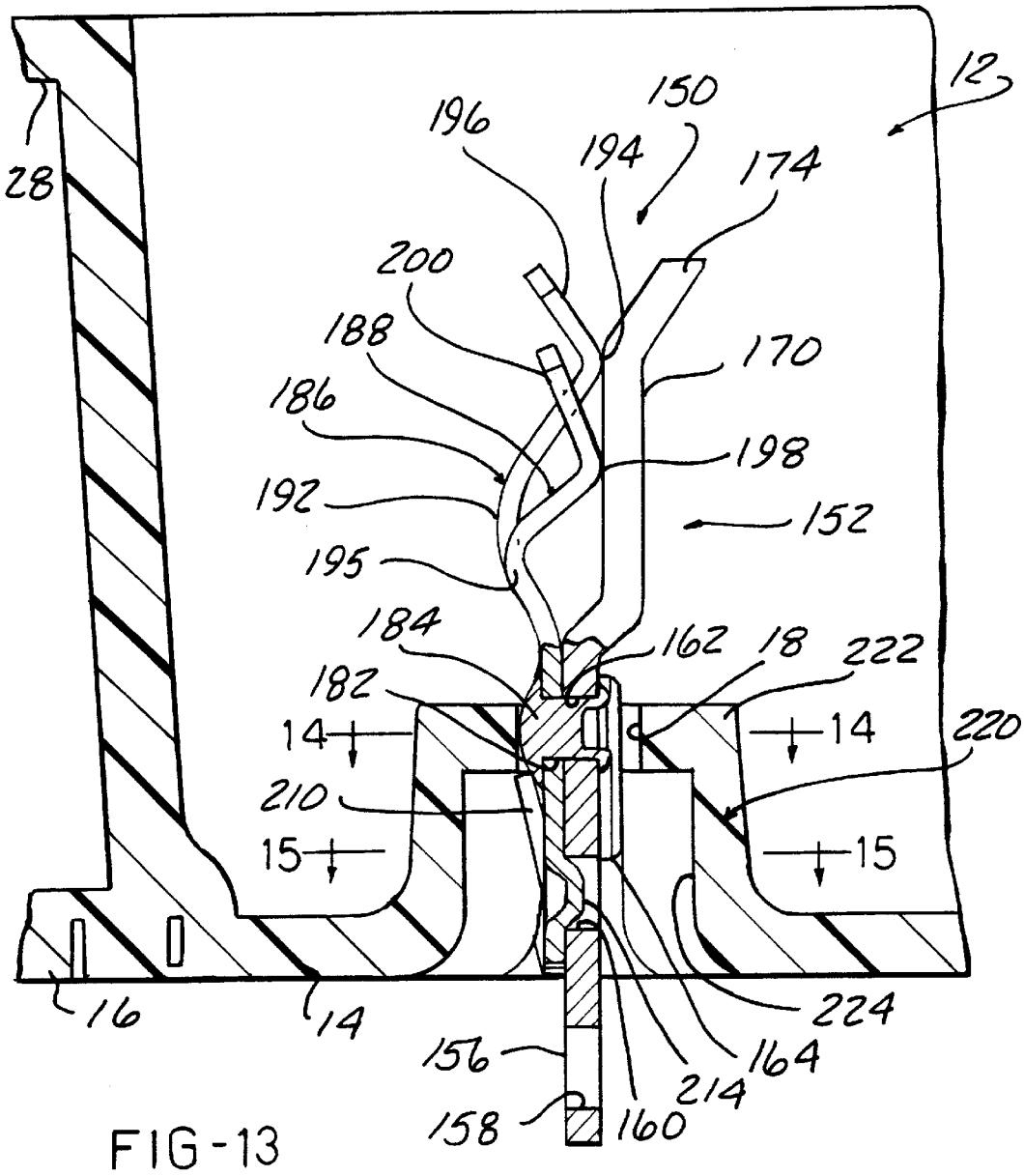
FIG. 13 is a cross sectional view showing the mounting of the jaw blade contact of FIGS. 11 and 12 in the socket adapter housing depicted in FIGS. 1–3.
Figure 14:
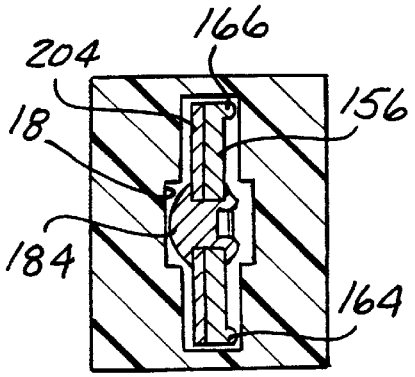
FIG. 14 is a cross sectional view generally taken along line 14—14 in FIG. 13.
Figure 15:
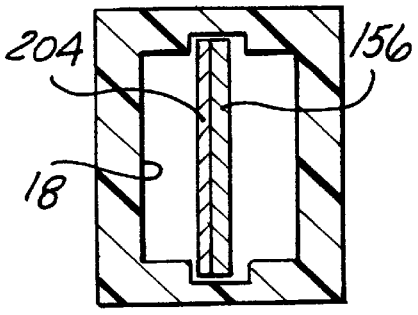
FIG. 15 is a cross sectional view generally taken along line 15—15 in FIG. 13.
Figure 16:
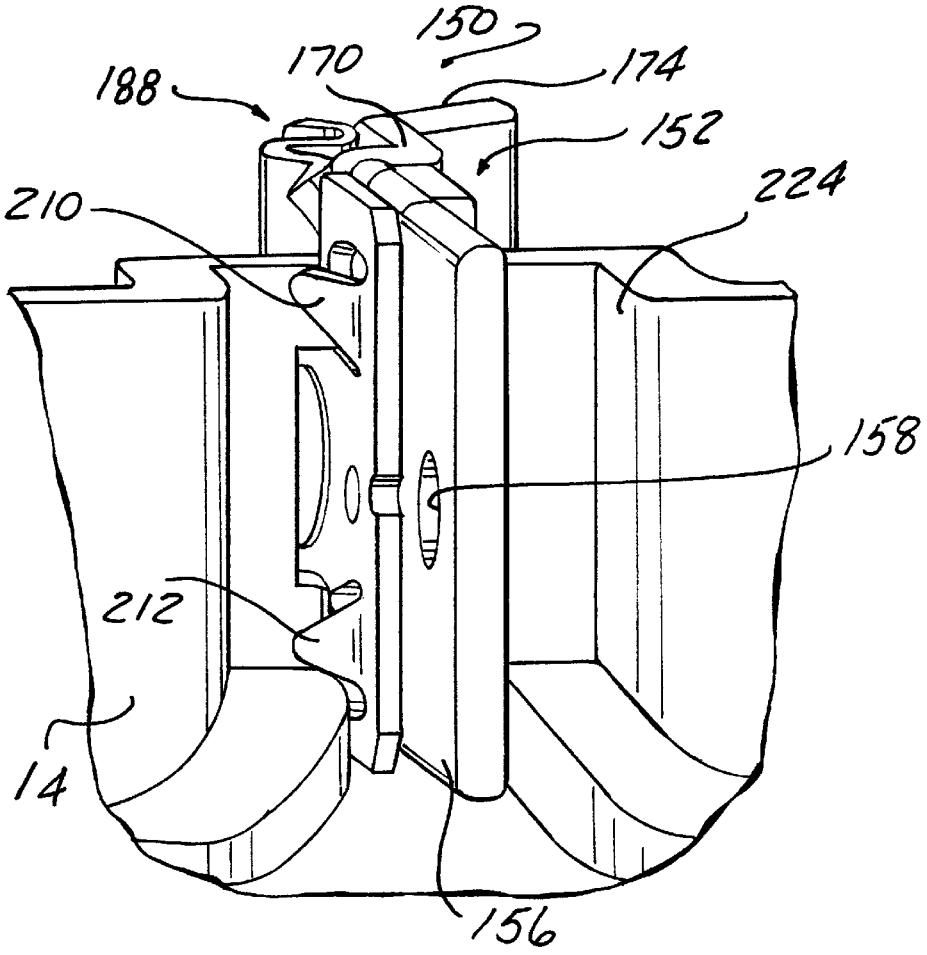
FIG. 16 is a bottom perspective view of the assembled jaw blade contact and socket adapter housing shown in FIG. 13.

The spring clip 154 is shown in detail in FIGS. 11, 13 and 16 and is preferably formed of a suitable spring material, such as spring steel. The spring clip 154 has a center portion 180 with a central aperture 182 formed therein alignable with the aperture 162 in the bus bar 152 and sized to receive a rivet 184 shown in FIG. 13, to securely and fixedly mount the spring clip 154 to the bus bar 152.

A first end of the spring clip 154 extends from the center portion 180. Preferably, the first end is formed as a spring for exerting a biasing force on a blade terminal inserted between the first end and the second end 170 of the bus bar 152. In a preferred embodiment, the first end of the spring clip 154 is formed of first and second spaced legs 186 and 188 which are separated by an intermediate slot 190. Each of the first and second legs 186 and 188 is substantially identically shaped except for differences in overall length and width, the purpose of which will be described hereafter. Thus, the first leg 186 extends from the center portion 180 of the spring clip 154 in a generally arcuate shaped section 192. The arcuate section 192 curves to a contact edge 194 which normally separably engages or is closely spaced from the first end 170 of the bus bar 152 to receive a blade terminal therebetween. The first leg 186 continues to an outwardly angled portion 196 which extends angularly oppositely from the end 174 of the bus bar 152 to form a jaw for guiding a blade terminal between the spring clip 154 and the bus bar 152. A further angled end 197 is formed on the end of angled portion 196.

The second leg 188 is substantially identically constructed with an arcuate shaped section 195 extending from the center portion 180 to a second contact edge 198. An outer end 200 of the second leg 188 extends angularly outward from the opposed end 174 of the bus bar 152 at generally the same angle as the end 196 of the first leg 186.

Both of the first and second legs 186 and 188 are cantilevered from the center portion 180 of the spring clip 154 to exert a spring or biasing force at the first and second contact points 194 and 198 against a blade terminal, not shown, inserted between the contact points 194 and 198 and the adjacent first end 170 of the bus bar 152. This biasing force biases the blade terminal into electrical engagement with the bus bar 152.

The rivet 184 mounted through apertures 162 and 182 acts as a pivot point for the legs 186 and 188. The distance between the rivet 184 and the first contact edge 194 on the first leg 186 is different, and preferably longer, than the distance between the rivet 184 and the second contact edge 198 on the second leg 188. This staggers the push in insertion force required to insert a single blade terminal on a watthour meter between the first and second legs 186 and 188 which lowers the overall insertion force required to fully insert a blade terminal between the first and second legs 186 and 188 and the adjacent bus bar 152. At the same time, the combined spring force exerted by the first and second legs 186 and 188 on the inserted blade terminal still provides the necessary biasing force.

As the spring force exerted by the first and second legs 186 and 188 is determined by the distance between the contact edges 194 and 198 from the rivet 184, it is clear that the second leg 188 shown in FIG. 11 will generate a higher spring force against a blade terminal to due to the shorter distance between its contact edge 198 and the rivet 184. The relative force exerted by the legs 186 and 188 can be adjusted and even balanced by varying the width of the legs 186 and 188. As shown in FIG. 11, the first leg 186 has a larger width between opposed side edges than the width of the second leg 188.

At the same time, the spring force exerted by the first and second legs 186 and 188 on the blade terminal forces the blade terminal against the bus bar 152 with sufficient force to enable the bus bar 152 capable of carrying higher current than jaw contacts in previously devised watthour meter socket adapters. This eliminates the need to derate the maximum current carrying capability of a watthour meter socket adapter as previously required.

The spring clip 154 has a second end 204 in a form of a cut out frame extending generally planarly from the center portion 180. The second end 204 has at least one and preferably a pair of cut outs 206 and 208 which respectively form first and second arms 210 and 212. The first and second arms 210 and 212 are bent angularly outward from the plane of the second end 204 as shown in FIGS. 11, 13 and 16. It will be understood that the spring clip 154 can also be constructed of a single cantilevered arm.

The dimple 214 is formed in the second end 204 between the cut outs 206 and 208. The dimple 214 acts as a locator when it is engaged in with the second aperture 160 in the first end 156 of the bus bar 152 to fixedly locate the spring clip 154 relative to the bus bar 152.

Finally, a pair of flanges 216 and 218 are bent angularly out of the plane of the center portion 180 as shown in FIGS. 11 and 13. The flanges 216 and 218 preferably extend in the same direction from the center portion 180 as the first and second arms 210 and 212.

Referring briefly to FIG. 13, as is conventional, a raised boss 220 extends out of the plane of the base 14 of the socket adapter housing 12. Boss 220 terminates in a top wall 222 spaced from the base 14 of the housing 12. The aperture 18 is formed through the top wall 220 as described above and shown in FIG. 2. The boss 220 and the top wall 222 also form an interior cavity 224 opening to the rear surface of the base 14 as shown in FIG. 13.

In mounting the jaw contact 150 in the socket adapter housing 12, the jaw contact 150 is oriented with the first end 156 of the bus bar 152 facing the base 14 of the housing 12. The first end 156 of the buss bar 152 is urged through the slot 18 in the top wall 222 of the boss 220. During such insertion, the first and second arms 210 and 212 on the spring clip 154 are urged inward toward the second end 204 of the spring clip 154 to enable the arms 210 and 212 to pass through the aperture 18 in the top wall 222 of the boss 220. When the tip ends of the first and second arms 210 and 212 clear the rear surface of the top wall 222, the arms 210 and 212 spring outward to the position shown in FIG. 13. At the same time, the flanges 216 and 218 on the spring clip 154 have been moved into registry with the outer surface of the top wall 222 of the boss 220. In this position, the flanges 216 and 218 cooperate with the arms 210 and 212 to securely and fixedly position the jaw contact 150 in the boss 220 in the socket adapter housing 12 without the need for any mechanical fasteners. As shown in FIG. 13, in the mounted position, the first end 156 of the bus bar 152 projects outward from the rear surface of the base 14 enabling the first end 156 of the bus bar 152 to be easily inserted into engagement with a jaw contact and a watthour meter socket.

If it is necessary to remove a jaw contact 150 from the housing 12 for repair or replacement, the arms 210 and 212 need only be urged toward the second end 204 of the spring clip 154 to enable the jaw blade contact 150 to be slid through the aperture 18 in the boss 220.

The jaw blade contact 150 shown in FIGS. 11–16 can also be employed, with little or only minor modifications, as a jaw contact in any electrical apparatus, such as in any type electrical watthour socket adapter or socket extender or other electrical device containing a jaw contact adapted to receive a terminal of a mating electrical device in a snap-in electrical connection. In such a general application, the spring clip 154 functions as a first jaw of the jaw contact 150. The bus bar 152 will usually be shaped as a mating jaw member having a planar shape as shown in the bus bar 152 or a cantilevered, arcuate shape similar to that of the spring clip 154.

Further, both of the jaws of such a jaw contact may have spaced first and second legs at a second end, each pair of which are integrally joined to a first end and secured to the other jaw by means of a suitable fastener, such a rivet. Mating contact edges or points of opposed legs of the two jaws would be of equal length and longitudinally off-set or spaced from the contact edges of the spaced pair of mating legs.

Figure 17:
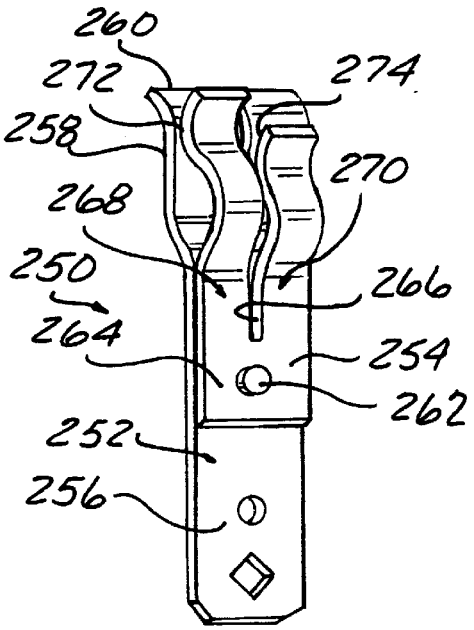
FIG. 17 is a perspective view of a conventional jaw contact incorporating a split, bilateral spring clip to the present invention.

FIG. 17 depicts the use of a modified spring clip 254, similar to the spring clip 154 described above, with a conventional planar bus bar 252 employed as part of a jaw contact in a watthour meter socket adapter or other electrical apparatus. As shown in FIG. 17, the bus bar 252 has essentially the same configuration as the bus bar 152 except that it lacks the flanges 164 and 166. Specifically, the bus bar 252, which is formed of a suitable electrically conductive material, has a first blade end 256 with one or more apertures for receiving suitable fasteners, such as a rivet or a cotter pin for connection to the spring clip 254 or mounting the entire jaw contact 250 in the housing of an electrical apparatus. An angularly offset, generally planar second end 258 terminates in an angular end 260.

Figure 18:
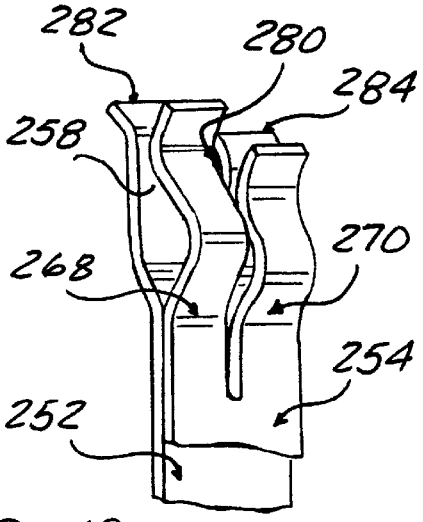
FIG. 18 is an enlarged, partial, perspective view showing a modification to the jaw contact shown in FIG. 17.

The spring clip 254 has a first end 264 joined by a rivet 262 to the bus bar 252. A slot 266 divides the second end of the spring clip 254 into first and second legs 268 and 270, each springingly extending from the first end 264. The first and second legs 268 and 270 have first and second contact edges 272 and 274, respectively. The first contact edge 272 is spaced farther from the rivet 262 than the second contact edge 274 to offset the terminal push-on force. The first and second legs 268 and 270 may have identical or different widths as in the spring clip 154. In FIG. 18, a slot 280 divides the second end of the bus bar 252 into first and second legs 282 and 284, each opposed from the legs 268 and 276, respectively, of the spring clip 254.

The bilateral jaw contact structure described above may also be applied to a conventional folded over jaw contact typically employed in watthour meter sockets and bottom connected watthour meter socket adapters. As FIGS. 19 and 20, a folded over jaw contact 300 includes a base 302 typically having an aperture 304 for receiving a fastener to connect the jaw contact 300 to an electrical conductor, not shown. Parallel spaced sidewalls 306 and 308 project from opposite sides of the base 302 to upper ends 310 and 312. Folder over or inward angled legs project from the upper ends 310 and 312, respectively. A slot 314 is formed in the first sidewall 306 and a similar slot 316 is formed in the second sidewall 308. The first slot 314 divides the first sidewall 306 into first and second legs 318 and 320. Similarly, the second slot 316 divides the second sidewall 308 into first and second legs 322 and 324. The first legs 318 and 322 are arranged as a one jaw pair. Second legs 320 and 324 are arranged as another jaw pair.

In this embodiment, the bilateral or staggering of the contact edges of the legs 318, 320, 322 and 324 is attained by forming different angles to the inward angled or folded over portions of each pair of the facing legs 318, 320, 322 and 324. For example, the first legs 318 and 322 on the first and second sidewalls 306 and 308, respectively, are each formed with a first angularly inward extending portion 328 and 330, respectively. A generally planar end portion 332 and 334, which is approximately parallel to the sidewalls 306 and 308, extends from the end of the inward extending portion 328 and 330, respectively. The end portions 332 and 334 are spaced apart by a short distance to define a first slot for receiving a blade terminal 336, shown in phantom FIG. 20, therebetween. A first contact edge 338 is formed on the first leg 318 between the inward extending portion 328 and the end portion 332. Similarly, a first contact edge 340 is formed on the first leg 322 between the inward angled portion 330 and the corresponding end portion 334. The first contact edges 338 and 340 are aligned for engaging the end of the blade terminal 336 at the same time during insertion of the blade terminal therebetween.

Similarly, the second legs 320 and 324 also have inward angled, extending portions 342 and 344, respectively. Parallel end portions 346 and 348 project from the ends of the inward extending portions 342 and 344 to define a second slot for receiving the blade terminal 336 therebetween, the second slot being aligned with the first slot.

Figure 19:
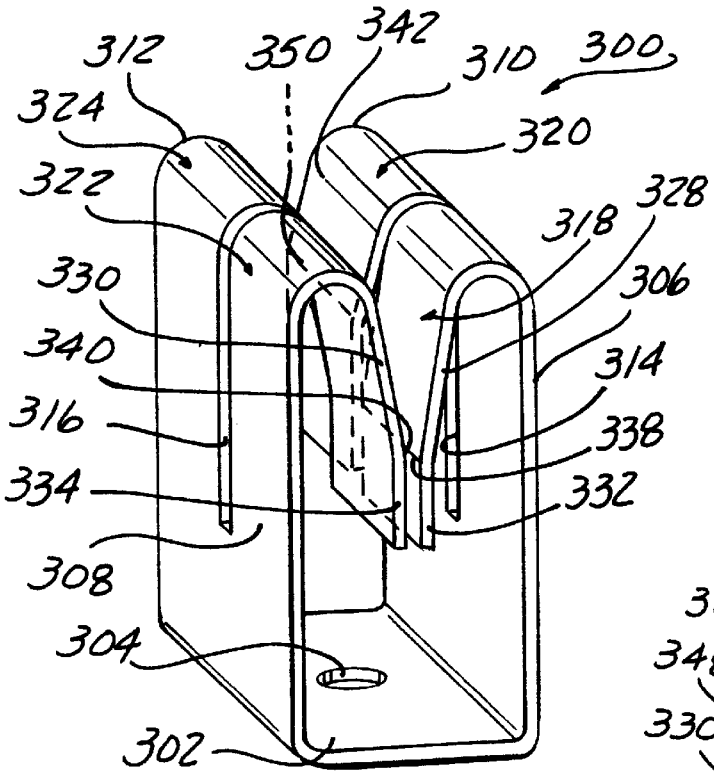
FIG. 19 is a perspective view of a folded over jaw contact according to the present invention.
Figure 20:
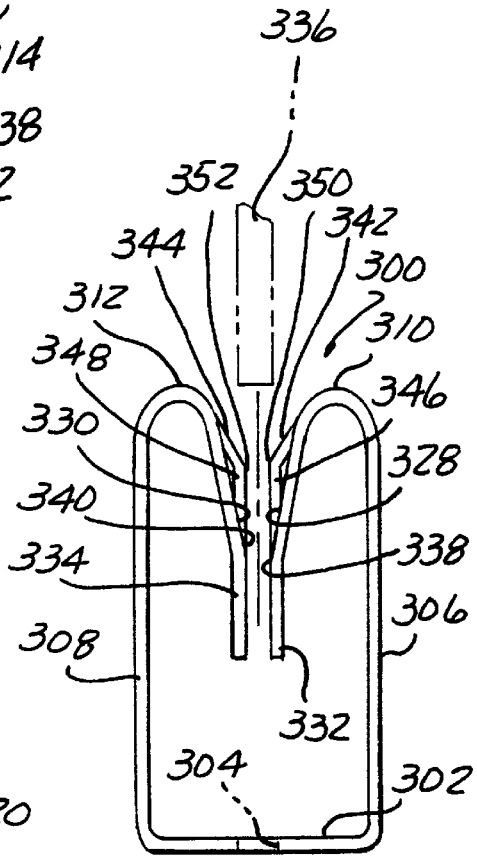
FIG. 20 is an end view of the jaw contact shown in FIG. 19.

In order to provide bilateral, staggered contact edge engagement, the length and angle of the inward extending portions 342 and 344 of the second legs 320 and 324 is made shorter and at a larger angle with respect to the corresponding sidewall 306 and 308 than the angles and lengths of the adjacent inward extending portions 328 and 330 of the first legs 318 and 322. As shown in FIGS. 19 and 20, the contact edges 350 and 352 on the second legs 320 and 324 are spaced closer to the outer ends 310 and 312 of the sidewalls 306 and 308 than the first contact edges 338 and 340 of the first legs 318 and 322. In this manner, insertion of terminal 336 into the jaw contact 300, as shown in FIG. 20, will cause engagement of the end of the blade terminal 336 initially with the second contact edges 350 and 352 of the second legs 320 and 324. Continued insertion of the blade terminal 336 between the planar end portions 346 and 348 of the second legs 320 and 324 will bring the end of the blade terminal 336 into engagement with first contact edges 338 and 340 of the first legs 318 and 322. This arrangement staggers the insertion force thereby significantly reducing the maximum or total insertion force as compared to previously devised jaw contacts.

Figure 21:
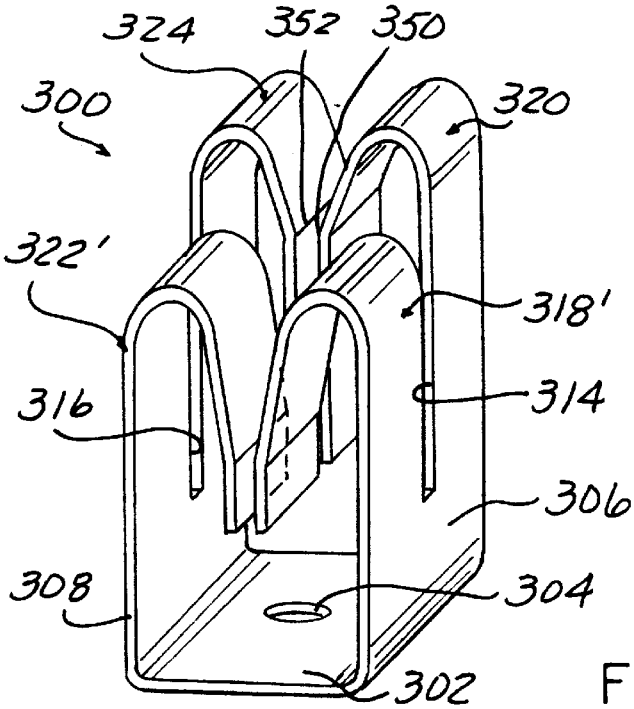
FIG. 21 is a modification of the jaw contact shown in FIG. 19 according to another embodiment of the present invention.

FIG. 21 depicts another embodiment of a jaw contact 300' which achieves the same bilateral or staggered insertion force feature by pairs of different length legs. Like reference numerals are used in FIG. 21 to refer to identical portions of the jaw contact 300' and the jaw contact 300 described above and shown in FIGS. 19 and 20.

In this embodiment, the second legs 320 and 324 identically constructed as the legs 320 and 324, shown in FIGS. 19 and 20. The first legs 318' and 322' have a reduced height as compared to the second legs 320 and 324 caused by beginning the folding over of the inward extending portions of each of the legs 318' and 322' at a shorter distance from the base 302 on each of the sidewalls 306 and 308. The angles and lengths of the inward extending portions of each of the legs 318', 320', 322' and 324' are identical. The staggered insertion force is achieved by the shorter height of the first legs 318' an 322' as compared to the greater height of the second legs 320 and 324. As a result, a blade terminal upon insertion into the jaw contact 300', will first engage the contact edges 350 and 352 on the second legs 320 and 324 prior to engaging the contact edges on the first legs 318' and 322'.

As in the preceding embodiment, the width of the laterally aligned pairs of legs can be varied to provide any desired insertion force at each step. For example, the width of the second and fourth legs 320 and 324 can be wider to more evenly balance the force provided by the other leg pair.

The unique jaw contact structure of the present invention provides a staggered, bilateral push-on insertion force which significantly reduces the maximum push-on insertion force required to fully insert a blade terminal into the jaw contact. This bilateral jaw contact arrangement may be applied to conventional jaw blade contacts as well as conventional folded over jaw contacts.

In summary, there has been disclosed a unique watthour meter socket adapter which contains components designed for a simple and expedient manufacturing of the watthour meter socket adapter with fewer fasteners than used in previously devised socket adapters. This contributes to a faster and less expensive manufacturing process which reduces the overall cost of the watthour meter socket adapter.

What is claimed is:

1. An electrical watthour meter socket adapter for interconnecting a watthour meter socket having a plurality of jaw contacts to a watthour meter having a plurality of outwardly extending blade terminals, the watthour meter socket adapter comprising:

a housing adapted for mating with a watthour meter, the housing having a base, and a sidewall extending from the base and terminating in a watthour meter mounting flange;

an aperture formed in the base;

a terminal having a first contact end for engagement with a blade terminal of a watthour meter and a second blade end for insertion through the aperture in the base into contact with a watthour meter socket jaw contact;

a spring member having first and second ends, the first end biasingly disposed with respect to the first contact end of the terminal to bias a blade terminal into contact with the first end of the terminal, the second end fixedly joined to the terminal; and clip means, carried on the spring member and extending therefrom, for mounting the terminal in the housing in a snap-on connection.

2. The watthour meter socket adapter of claim 1 wherein the first end of the spring member comprises:

a first end leg having a contact edge cantilevered from a second end disposed in proximity with the second end of the terminal, the contact edge biasingly urging a blade terminal of a watthour meter disposed adjacent thereto into electrical contact with the first end of the terminal.

3. The watthour meter socket adapter of claim 2 wherein the spring member further comprises:

a pair of spaced, first and second first end legs.

4. The watthour meter socket adapter of claim 3 wherein:

each of the first and second end legs of the spring member extends to first and second contact edges, respectively, engageable with a blade terminal of a watthour meter;

the first contact edge of the first leg spaced axially along the terminal from the second contact edge of the second leg.

5. The watthour meter socket adapter of claim 4 wherein:

the first end leg has a longer length than the second end leg to dispose the first contact edge of the first end leg closer to the first end of the terminal than the second contact edge of the second end leg.

6. The watthour meter socket adapter of claim 4 further comprising:

a width between opposed side edges of one of the first and second legs of the spring member being greater than a width between opposed side edges of the other of the first and second legs of the spring member.

7. The watthour meter socket adapter of claim wherein the clip means comprises first and second clips.

8. The watthour meter socket adapter of claim 1 wherein the clip means comprises:

at least one arm having an end cantilevered from the terminal.

9. The watthour meter socket adapter of claim 8 wherein the at least one arm of the clip means further comprises:

first and second arms, spaced from each other, each of the first and second arms having an end cantilevered from the terminal.

10. The watthour meter socket adapter of claim 8 further comprising:

spacer means, carried on the terminal between the first and second ends, for engaging a portion of the base of the housing surrounding the aperture in the base when the terminal is mounted through the aperture in the base and the end of the at least one arm engages an opposed surface of the base.

11. A jaw contact mountable in a housing of an electrical device, the housing having a base with an aperture therein for coupling a blade terminal of an electrical device therethrough to a jaw contact of another electrical device, the jaw contact comprising:

a terminal having a first contact end for receiving a blade terminal of an electrical device and a second blade end for insertion through the aperture in the base into another electrical device jaw contact;

a spring member having first and second ends, the first end biasingly disposed with respect to the first contact end of the terminal to bias a blade terminal into contact with the first end of the terminal, the second end fixedly joined to the terminal; and clip means, carried on the spring member and extending therefrom, for mounting the terminal in the housing in a snap-on connection.

12. The jaw contact of claim 11 wherein the spring member comprises:

a first end leg having a contact edge cantilevered from a second end disposed in proximity with the second end of the terminal, the first end biasingly urging a blade terminal of an electrical device disposed adjacent thereto into electrical contact with the first end of the terminal.

13. The jaw contact of claim 12 wherein the spring member further comprises:

a pair of spaced, first and second first end legs.

14. The jaw contact of claim 12 wherein:

each of the first and second end legs of the spring member extends to first and second contact edges, respectively, engageable with a blade terminal of an electrical device; and the first contact edge of the first leg spaced axially along the terminal from the second contact edge of the second leg.

15. The jaw contact of claim 14 wherein:

the first end leg has a longer length than the second end leg to dispose the first contact edge of the first end leg closer to the first end of the terminal than the second contact edge of the second end leg.

16. The jaw contact of claim 14 further comprising:

a width between opposed side edges of one of the first and second legs of the spring member being greater than a width between opposed side edges of the other of the first and second legs of the spring member.

17. The jaw contact of claim 16 wherein the clip means comprises first and second clips.

18. The jaw contact of claim 16 wherein the clip means comprises:

at least one arm having an end cantilevered from the terminal.

19. The jaw contact of claim 18 wherein the clip means comprises:

first and second arms, spaced from each other, each of the first and second arms having an end cantilevered from the terminal.

20. The jaw contact of claim 18 further comprising:

spacer means, carried on the terminal between the first and second ends, for engaging a portion of the base of the housing surrounding the aperture in the base when the terminal is mounted through the aperture in the base and the end of the at least one arm engages an opposed surface of the base.

21. An electrical watthour meter socket adapter for interconnecting a watthour meter socket having a plurality of jaw contacts to a watthour meter having a plurality of outwardly extending blade terminals, the watthour meter socket adapter comprising:

a one piece, unitary housing adapted for mating with a watthour meter;

the housing having a base central wall and a radially outward extending first mounting flange;

an annular wall extending unitarily from the base central wall and terminating in a second mounting flange extending radially outward from the annular wall;

substantially the entire base central wall axially offset from the first mounting flange in an axial direction opposite from the first mounting flange;

the annular wall having a length to closely space the first and second mounting flanges;

an aperture formed in the base central wall;

a jaw contact mounted in the base central wall for receiving a blade terminal of a watthour meter; and a blade terminal connected to the jaw contact and extending through the aperture in the base central wall for insertion into a watthour meter socket jaw contact.

22. An electrical watthour meter socket adapter for interconnecting a watthour meter socket having a plurality of jaw contacts to a watthour meter having a plurality of outwardly extending blade terminals, the watthour meter socket adapter comprising:

a housing adapted for mating with a watthour meter, the housing having a base, and an annular sidewall extending from the base and terminating in an annular flange engageable with a watthour meter, an aperture formed through at least one of the sidewall and the base;

a surge ground conductor mounted in the socket adapter housing, the surge ground conductor including:

a conductive member;

first and second electrically conductive tabs carried on the conductive member;

apertures formed in the mounting flange of the housing for receiving the first and second conductive tabs of the conductive member and disposing the first and second conductive tabs for contact with a ground tab on a watthour meter mounted on the mounting flange; and a mounting member, unitary with the conductive member and extending from the conductive member for insertion through the aperture in at least one of the sidewall and the base of the housing to mount the conductive member on the housing.

23. The electrical watthour meter socket adapter of claim 22 wherein the mounting member comprises:

a foot pivotally carried on the conductive member and bendable with respect to the conductive member from a first position to a second position for insertion through the aperture.

24. The electrical watthour meter socket adapter of claim 23 wherein the mounting member further comprises:

a flange carried on the foot and extending oppositely from the foot, the flange disposed interiorly within the housing when the foot is in the second position.

25. An electrical watthour meter socket adapter for interconnecting a watthour meter socket having a ringless-type cover and a plurality of jaw contacts to a watthour meter having a plurality of outwardly extending blade terminals, the watthour meter socket adapter comprising:

a housing having a base, an annular sidewall extending from the base, and an annular mounting flange formed on an end of the sidewall mateable with a mounting flange on a watthour meter; and a frangible portion frangibly carried on the mounting flange, the frangible portion extending over at least a portion of the annular extent of the mounting flange and separable from the mounting flange for altering the peripheral configuration of the mount flange to enable an opening in a ringless-type watthour meter socket cover to pass over the mounting flange.

26. The electrical watthour meter socket adapter of claim 25 wherein:

the frangible portion is cuttable from the mounting flange.

27. In an electrical apparatus having a housing with electrical connections and receiving a separate electrical device in a plug-in electrical connection to the electrical connections in the housing, the electrical connections comprising:

a jaw contact mountable in the housing and formed of first and second jaws for receiving a terminal of a separate electrical device there-between in a plug-in connection;

the first jaw having an end formed of at least first and second laterally spaced legs;

the at least first and second legs respectively having first and second contact lines, each respectively adapted to be separately engageable with a blade terminal inserted between the first and second jaws, the first and second contact lines spaced longitudinally apart on the first jaw; and the second jaw having an end formed of first and second laterally spaced legs opposing the first and second legs of the first jaw, respectively contact lines on the first and second legs of the second jaw axially offset from the opposing contact lines of the first jaw.

28. The electrical connections of claim 27 further comprising:

a width between opposed side edges of the first leg of the first jaw being greater than a width between opposed side edges of the second leg of the first jaw.

29. The electrical connections of claim 27 further comprising:

fastener means disposed intermediate the first and second ends of the first and second jaws for fixedly connecting the first and second jaws together.

30. The electrical connections of claim 29 wherein:

the contact line of the first leg of the first jaw extends longitudinally further from the fastener means than the contact line of the second leg of the first jaw to exert a smaller spring force on a blade terminal inserted between the first and second jaws than the spring force exerted by the second leg.

31. The electrical connections of claim 27 wherein the jaw contact comprises:

a base;

first and second sidewalls extending from the base and terminating in inward facing ends;

the first and second legs of the first jaw carried on the first sidewall;

the first and second legs of the second jaw carried on the second sidewall;

the contact lines of the first legs of the first and second sidewalls axially offset and spaced at a different spacing from the base of the jaw contact than the spacing of the contact lines of the second legs of the first and second sidewalls from the base such that the contact line edges of the first legs are contacted first by a blade terminal inserted into the law contact before the blade terminal contacts the contact line edges of the legs.

32. The electrical connections of claim 31 wherein the inward facing ends of each of the first and second legs of the first and second sidewalls comprise:

a first portion extending angularly inward from an end of the first and second sidewalls spaced from the base;

a planar end portion extending from the end of the first portion;

the first and second contact lines formed at the junction of the first portion and the planar end portion of the first and second legs.

33. The electrical connections of claim 32 wherein:

one of a length and an angle of the first portion of the first legs being different from the corresponding one of the length and angle of the first portion of the second legs to dispose of the respective contact lines of the first legs at a different spacing from the base than the respective contact lines of the second legs.

34. The electrical connections of claim 31 wherein:

the first legs have a different width between opposed side edges than the width of the second legs.

35. The electrical watthour meter socket adapter of claim 22 wherein the aperture in the housing is formed in the sidewall of the housing adjacent to the juncture of the sidewall and the base of the housing.

36. The electrical watthour meter socket adapter of claim 23 wherein:

the foot, when in the second position, extends exteriorly of the sidewall of the housing.

37. An electrical watthour meter socket adapter for interconnecting a watthour meter socket having a plurality of jaw contacts to a watthour meter having a plurality of outwardly extending blade terminals, the watthour meter socket adapter comprising:

a housing adapted for mating with a watthour meter, the housing having a base, and an annular sidewall extending from the base and terminating in an annular flange engageable with a watthour meter, an aperture formed through at least one of the sidewall and the base;

an electrically conductive surge ground conductor having opposed first and second ends;

the first end mountable on the annular flange of the housing and disposed for electrical contact with an electrically conductive element of a watthour meter when the watthour meter is mounted on the annular flange; and a mounting member carried on the second end of the surge ground conductor and and extending from the second end to a position extendable through the aperture in the at least one of the sidewall and the base of the housing, for mounting the surge ground conductor to the housing.

38. The electrical watthour meter socket adapter of claim 37 wherein the mounting member comprises:

a foot carried on the surge ground conductor and bendable with respect to the surge ground conductor from a first position to a second position for insertion through the aperture in the housing.

39. The electrical watthour meter socket adapter of claim 38 wherein the mounting member further comprises:

a flange carried on the foot and extending oppositely from the foot, the flange disposed interiorly within the housing when the foot is in the second position for connection to an electrical conductor within the housing.

* * * * *